US009601040B2

(12) United States Patent
Barrett et al.

(10) Patent No.: US 9,601,040 B2
(45) Date of Patent: Mar. 21, 2017

(54) FLAT-STOCK AERIAL VEHICLES AND METHODS OF USE

(71) Applicant: University of Kansas, Lawrence, KS (US)

(72) Inventors: Ronald M. Barrett, Lawrence, KS (US); Richard B. Bramlette, Little Rock, AR (US); Robert B. Honea, Lenoir City, TN (US)

(73) Assignee: University of Kansas, Lawrence, KS (US)

( * ) Notice: Subject to any disclaimer, the term of this patent is extended or adjusted under 35 U.S.C. 154(b) by 92 days.

(21) Appl. No.: 14/734,885

(22) Filed: Jun. 9, 2015

(65) Prior Publication Data

US 2016/0023743 A1 Jan. 28, 2016

Related U.S. Application Data

(63) Continuation-in-part of application No. 14/120,448, filed on Jun. 24, 2014, now abandoned.

(51) Int. Cl.

| | |
|---|---|
| ***G09F 21/08*** | (2006.01) |
| ***A63H 27/00*** | (2006.01) |
| ***A63H 27/14*** | (2006.01) |

(52) U.S. Cl.

CPC ..... *G09F 21/08* (2013.01); *A63H 27/001* (2013.01); *A63H 27/02* (2013.01); *A63H 27/12* (2013.01); *A63H 27/14* (2013.01)

(58) Field of Classification Search

CPC ..... B65D 77/02; B65D 75/30; B65D 11/50; A63H 27/00; A63H 27/001; A63H 27/02

See application file for complete search history.

(56) References Cited

U.S. PATENT DOCUMENTS

| | | | | |
|---|---|---|---|---|
| 2,005,842 | A * | 6/1935 | Etienne | A63H 27/001 446/67 |
| 2,678,783 | A | 5/1954 | Myers | |
| 2,845,746 | A * | 8/1958 | McKinney | A63H 27/00 446/44 |
| 3,063,375 | A | 11/1962 | Hawley et al. | |
| 3,578,263 | A | 5/1971 | Gunter et al. | |
| 3,884,431 | A | 5/1975 | Burrell | |
| D250,966 | S | 1/1979 | Spore | |
| 4,235,040 | A * | 11/1980 | Trowbridge | A63H 27/00 446/68 |

(Continued)

FOREIGN PATENT DOCUMENTS

| | | |
|---|---|---|
| CN | 10205022 | 5/2011 |
| WO | WO 2013/048339 | 4/2013 |
| WO | WO 2014/055899 | 4/2014 |

OTHER PUBLICATIONS

U.S. Appl. No. 14/120,446, filed Jun. 10, 2014, Barrett et al.

(Continued)

*Primary Examiner* — Justin Benedik

(74) *Attorney, Agent, or Firm* — Workman Nydegger

(57) ABSTRACT

A flat-stock aerial vehicle includes a body having a plurality of flat-stock sheets connected to one another, at least one motor, and at least three aerodynamic propulsors driven by the at least one motor. The aerodynamic propulsors can provide lifting thrust, pitch, yaw, and roll control in both helicopter-like hover flight and airplane-like translational flight.

20 Claims, 6 Drawing Sheets

(56) References Cited

U.S. PATENT DOCUMENTS 4,253,897 A * 3/1981 Pistone ..... A63H 27/001 156/256
5,060,886 A 10/1991 Davis et al.
5,082,079 A 1/1992 Lissaman et al.
5,289,994 A 3/1994 Del Campo Aguilera
5,492,494 A * 2/1996 Keennon ..... A63H 27/005 446/37
D377,326 S 1/1997 Grossman et al.
6,257,946 B1 * 7/2001 Yang ..... A63H 27/001 446/34
6,260,796 B1 7/2001 Klingensmith
6,502,787 B1 1/2003 Barrett
D500,809 S 1/2005 McKenna et al.
7,416,466 B2 8/2008 Isawa
D589,868 S 4/2009 Matharan et al.
7,874,513 B1 1/2011 Smith
D697,145 S 1/2014 Wong
9,375,650 B1 * 6/2016 Goitein ..... A63H 29/22
2002/0030142 A1 * 3/2002 James ..... B64C 29/0025 244/194
2006/0038061 A1 2/2006 Blevio, Sr.
2008/0014827 A1 * 1/2008 Amireh ..... A63H 27/02 446/58
2009/0305599 A1 * 12/2009 Newton ..... A63H 27/02 446/61
2010/0152933 A1 6/2010 Smoot et al.
2010/0252690 A1 * 10/2010 Hothi ..... B64C 39/024 244/7 B
2011/0001020 A1 * 1/2011 Forgac ..... B64C 29/0033 244/7 A
2011/0042509 A1 * 2/2011 Bevirt ..... B64C 29/0033 244/12.4
2011/0168835 A1 7/2011 Oliver
2011/0226892 A1 9/2011 Crowther et al.
2012/0286102 A1 11/2012 Sinha et al.
2014/0117149 A1 * 5/2014 Zhou ..... A63H 27/12 244/17.23
2014/0131507 A1 * 5/2014 Kalantari ..... A63H 27/12 244/2
2014/0131510 A1 * 5/2014 Wang ..... B64C 39/024 244/17.23
2014/0319266 A1 10/2014 Moschetta et al.
2015/0151209 A1 * 6/2015 Vanderbeek ..... A63H 27/001 446/61
2015/0191246 A1 7/2015 Kalantari et al.
2016/0009381 A1 1/2016 Benatar et al.

OTHER PUBLICATIONS

U.S. Appl. No. 14/120,447, filed Jun. 20, 2014, Barrett et al.
U.S. Appl. No. 14/120,448, filed Jun. 24, 2014, Barrett et al.
U.S. Appl. No. 14/120,449, filed Jul. 25, 2014, Barrett et al.
U.S. Appl. No. 14/734,864, filed Jun. 9, 2015, Barrett et al.
U.S. Appl. No. 14/810,090, filed Jul. 27, 2015, Barrett et al.
U.S. Appl. No. 29/529,811, filed Jun. 10, 2015, Barrett et al.
U.S. Appl. No. 29/529,831, filed Jun. 10, 2015, Barrett et al.
U.S. Appl. No. 29/546,239, filed Nov. 20, 2015, Barrett et al.
Leishman, J. G., "Principles of Helicopter Aerodynamics," Cambridge University Press, New York, NY, USA 2000.
U.S. Appl. No. 29/574,073, filed Aug. 11, 2016, Barrett et al.
U.S. Appl. No. 29/529,811, May 23, 2016, Office Action.
U.S. Appl. No. 29/529,811, Sep. 2, 2016, Notice of Allowance.

* cited by examiner

FLAT-STOCK AERIAL VEHICLES AND METHODS OF USE

CROSS-REFERENCE TO RELATED APPLICATIONS

This application is a continuation in part of U.S. patent application Ser. No. 14/120,448, filed Jun. 24, 2014, and entitled "FLAT-STOCK AERIAL VEHICLE AND METHODS OF USE", the disclosure of which is incorporated herein by reference.

BACKGROUND OF THE INVENTION

1. Field of the Disclosure

The present disclosure relates to flat-stock aerial vehicles. In particular, the present disclosure pertains to a class of flying aircraft which are remotely controlled and built primarily from thin material stock which is planar or bent in non-compound curves. At least one embodiment of which is able to hover like a helicopter, then convert and fly like an airplane using a plurality of propellers and wings for lift and flight control.

2. Background

For more than two centuries, multi-propeller aircraft have been experimented with, starting with the fabled toy of Launoy and Bienvenu of 1783. These devices were and are limited mostly to hover-type flight modes, flying at low speeds for limited endurances and distances. Airplanes and gliders have similarly been in existence for many hundreds of years, flying much faster with greater endurances and range. A handful of aircraft are capable of converting between helicopter-type and airplane-type flight modes and flying between either mode.

Convertible aircraft typically have comparatively high propulsion demands to fly in both hover and translational flight due to added complexity of the mechanics and/or the need to reroute thrust from an aerodynamic propulsor in various directions. Providing a simple, lightweight, easily packaged, and easily assembled convertible aerial vehicle may therefore be desirable.

Conventionally, a number of flying aircraft have been used for advertising and message delivery, including banks of dynamic lights on the sides of blimps and semi-rigid airships. Aircraft for advertising and message delivery are conventionally very large to provide the area necessary on the body of the aircraft for an advertisement to be visible over the long distances from which consumers may view them. Alternatively, some aircraft may be used to pull banners, which places additional costs and engineering requirements on the aircraft. The large banners and/or heavy banks of dynamic lights increase weight, placing restriction on the locations from which the aircraft can takeoff and land. To safely get advertisements and promotional materials as close to consumers as possible and in densely occupied areas, such as sports and entertainment arenas, a convertible aircraft with proportionately large surface area and vertical takeoff and landing capability may be desirable.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In an embodiment, a flat-stock aerial vehicle includes a body, at least one motor, and at least three aerodynamic propulsors. The body has a forward body edge and an aft body edge and a longitudinal axis. The body includes a first flat-stock sheet and a second flat-stock sheet. The first flat-stock sheet has a first forward edge and a first aft edge, and has an aft slot therein extending forward from the first aft edge. The second flat-stock sheet has a second forward edge and a second aft edge and a forward slot therein extending aft from the second forward edge, wherein the aft slot is configured to engage with the forward slot. The least three aerodynamic propulsors are positioned between the forward body edge and aft body edge and define a forward wing portion and an aft wing portion. The at least three aerodynamic propulsors are driven by the at least one motor. The at least three aerodynamic propulsors are configured to provide lifting thrust, pitch, yaw, and roll control to the aerial vehicle.

In another embodiment, a flat-stock aerial vehicle includes a body, at least one motor, and at least three aerodynamic propulsors. The body has a forward body edge, an aft body edge, and a longitudinal axis. The body includes a plurality of flat-stock sheets and the plurality of flat-stock sheets are joined together along the longitudinal axis and arranged around the longitudinal axis at equal angular intervals. The at least three aerodynamic propulsors are positioned between the forward body edge and aft body edge and define a forward wing portion and an aft wing portion. The at least three aerodynamic propulsors are driven by the at least one motor. The at least three aerodynamic propulsors are configured to provide lifting thrust, pitch, yaw, and roll control to the aerial vehicle.

In yet another embodiment, a flat-stock aerial vehicle includes a body, a keyway, at least one motor, and at least four aerodynamic propulsors. The body has a forward body edge, an aft body edge, and a longitudinal axis. The body includes a first flat-stock sheet and a second flat-stock sheet. The first flat-stock sheet has a first forward edge and a first aft edge, and has first cutout area therein located between the first forward edge and first aft edge. The second flat-stock sheet has a second forward edge and a second aft edge and a second cutout area therein located between the second forward edge and second aft edge, wherein the second flat-stock sheet is configured to be inserted through the first cutout area such that the second cutout area aligns with the first cutout area to define a cutout volume. The key is positioned in the cutout volume, where the key limits movement of the first flat-stock sheet relative to the second flat-stock sheet. The least three aerodynamic propulsors are positioned between the forward body edge and aft body edge and define a forward wing portion and an aft wing portion. The at least three aerodynamic propulsors are driven by the at least one motor. The at least three aerodynamic propulsors are configured to provide lifting thrust, pitch, yaw, and roll control to the aerial vehicle.

Additional features of embodiments of the disclosure will be set forth in the description which follows, and in part will be obvious from the description, or may be learned by the practice of such embodiments. The features of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other advantages and features of the disclosure can be obtained, a more particular description will be rendered by reference to specific embodiments thereof which are illustrated in the appended drawings. For better understanding, like elements have been designated by like reference numbers throughout the various accompanying figures. Though some elements in some figures have the same reference number as elements in other figures, these elements may be the same or may differ. While some of the drawings are schematic representations of concepts, at least some of the drawings may be drawn to scale. Understanding that these drawings depict only typical embodiments of the disclosure and are not therefore to be considered to be limiting of its scope, the embodiments will be described and explained with additional specificity and detail through the use of the accompanying drawings in which.

DETAILED DESCRIPTION

Figure 1:
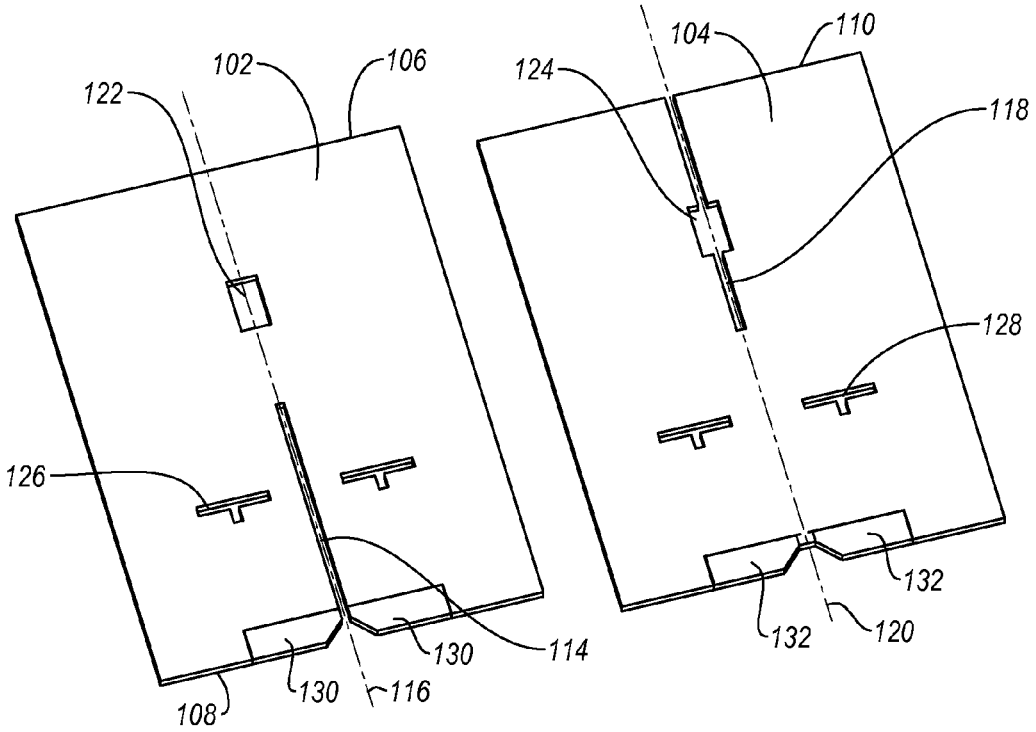
FIG. 1 is a perspective view of an embodiment of a pair of flat-stock sheets which include cut-outs for both assembly and for component accommodation, according to the present disclosure.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. It should be understood that any directions or reference frames in the preceding description are merely relative directions or movements. For example, any references to "up" and "down" or "above" and "below" or "forward" and "aft" are merely descriptive of the relative position or movement of the related elements. Any element described in relation to an embodiment or a figure herein may be combinable with any element of any other embodiment or figure described herein.

This disclosure generally relates to aerial vehicles with multiple aerodynamic propulsors that are capable of flight convertible from a hover mode to an airplane flight mode. More particularly, this disclosure relates to aerial vehicles with multiple aerodynamic propulsors that are capable of flight convertible from a hover mode to an airplane flight mode that are at least partially made out of flat-stock materials. Flat stock materials can include balsa wood, cardboard, plastics, polymer foam sheets, metal foam sheets, open cell foam, closed cell foam, other flat materials, or combinations thereof.

In one embodiment, a fixed-wing remotely controlled convertible multi-propeller flat-stock flying aircraft with four or more propellers is described. A plurality of motors driving propellers may be accommodated within slots of the wings which, in some embodiments, are joined at a central juncture to each other. Pitch, roll, and yaw may be controlled by differential thrust and torque on each of the propellers and/or a series of turning vane flaps which may provide rotational and/or translational control with more than 11 degrees of control freedom. In some embodiments, flat-stock components make up the majority of the structural members. The flat-stock components can be cut in various shapes and/or be decorated for advertising, message transfer, promotion, entertainment, used recreationally, or combinations thereof. In some embodiments, the aircraft can hover like a helicopter, and convert to a translational flight mode similar to an airplane, at least partially using the flat-stock sheets as wings. Conversion from hover-to-translational-to-hover mode flight is accomplished by differential thrust and/or turning vane deflections which are used to induce nose-up and nose-down pitching moments and body rotations about the aircraft center of gravity in flight, enabling both hover flight and translational flight. Multiple flight packages and cargoes with a variety of functions as well as control and data transmission devices can be integrated.

While aerial vehicles that can fly like helicopters are accepted by the market and a aerial vehicles that can fly like airplanes are similarly desirable, it is clear that an aerial vehicle which possesses the best of both flight modes can be more desirable than either one individually. At least one embodiment described herein is capable of both hovering and airplane-like translational flight (i.e., applying thrust in a direction that is generally parallel to the ground for an extended period of time). At least one embodiment described herein is capable of converting between hover and airplane-like flight modes and back repeatedly. This act of conversion lends high speed translational flight ("dash"), good range, and endurance capability to aerial vehicles which are also capable of hovering over extended periods of time with good control authority.

To make a convertible aerial vehicle conventional requires complicated structural shapes, high power-to-weight ratios, and high authority flight control surfaces. Constructing a three-dimensional fuselage, empennage, canopy and wing structure of a given convertible aerial vehicle is often far more expensive than constructing one for either a conventional helicopter or a conventional airplane. The ability to fabricate a convertible aerial vehicle out of flat-stock, like foam sheets, may provide the advantage in some embodiments in that such materials can dramatically reduce fabrication costs, reduce shipping requirements, reduce assembly requirements, lower vehicle weight, and simplify aircraft designs.

In some embodiments, an aerial vehicle may include almost exclusively flat-stock sheets of material which are either kept planar or bent only in simple curves to form the body, empennage, and lifting surfaces of the aerial vehicle. In other embodiments, a percentage of the fuselage, empennage, lifting surfaces, or combinations thereof may be within a range having lower and upper values that include any of 15%, 25%, 35%, 45%, 55%, 65%, 70%, 75%, 80%, 85%, 90%, 95%, 100%, or any value therebetween.

Although often described in terms of reduced scale embodiments, the present disclosure is not so limited. Rather, principles and elements of the disclosure apply to aerial vehicles generally. For example, at least one aerial vehicle herein may be used in a larger scale aerial vehicle, such as an unmanned aerial vehicle. These unmanned aerial vehicles may include the following ranges of size: from 2.0 centimeters (cm) to 5.0 meters (m) in main propeller diameters. Furthermore, although most embodiments are described in terms of having propellers, other aerodynamic propulsors may be used. For example, in some embodiments a ducted fan, small jet engine, or other aerodynamic propulsor may be used.

While the use of a plurality of propellers may facilitate establishing good flight control properties while in a hover condition, at least one embodiment of aircraft described herein synergistically uses the plurality of propellers as a safety feature. Because a number of propellers lifting a given weight will typically be smaller in diameter than a single propeller lifting the same weight given the same amount of total power going to each system, the larger number of propellers may be integrated directly into lifting surfaces and/or structural members like wings and fuselages. If the wings and/or fuselage structures are not primarily three-dimensional, but planar, the amount of blockage drag may be minimized and/or bending moments of inertia in structural members in the directions of applied lifting loads may be maximized. In some embodiments, torsional rigidities may be increased by the use of primarily planar surfaces because flow blockage considerations are minimized.

Given a plurality of lifting propellers which are mounted within planar lifting surfaces and fuselage segments, in some embodiments, the use of braces, shrouds, landing gear, or combinations thereof to form a protective "cage" around such propellers may be used synergistically to enhance safety, reduce weight, reduce costs, or combinations thereof. Aerial vehicles that are capable of hovering may have difficulty manipulating control forces and moments. Manipulation of thrust via a plurality of propellers which are used not only for lifting, but also flight control, may improve the control over thrust and moment application to the aerial vehicle. While a plurality of propellers can often be used exclusively, a plurality of propellers may be used in concert with slipstream-mounted flight control surfaces.

A plurality of propellers may allow an aerial vehicle to advantageously use the relationship between the aerodynamic centers of the aircraft and the centers of gravity and therefore the static margins of the aircraft in all flight modes. Convertible aircraft may be demanding on computerized flight controllers because body rotations in pitch through 90° lead to singularities in Eulearian flight controllers. Therefore, often quarternian-based flight control algorithms are used. Such flight control algorithms generally require incrementally more computational power and skill of coding as they are far less common than simple Eulearian relationships.

According to least one embodiment described herein, an aerial vehicle may employ mechanisms, which maintain not only positive static margins in hover, but through the transition and once fully converted. Embodiments that incorporate features allowing large-scale positive static margin overmatch leads to aircraft self-stabilization. Accordingly, aircraft which would be "difficult" to fly can be made far easier to fly if features are built into the aircraft such as the ones described herein. These combined features lead to a unique class of aircraft.

FIG. 1 illustrates the most basic structural elements of the simplest form of the aircraft described herein. Specifically, FIG. 1 illustrates a first flat-stock sheet 102 and a second flat-stock sheet 104 configured to engage one another to form the body of a convertible aerial vehicle. Although the present embodiment includes a pair of flat-stock sheets, more sheets may be included. For example, three or more flat-stock sheets may be used. The first flat-stock sheet 102 and second flat-stock sheet 104 may include one or more cutouts and may be printed with signs, lettering, logos, cutout lines for further excision, other cutouts, other printing, or combinations thereof. In some embodiments, the first flat-stock sheet 102 may be configured to engage with the second flat-stock sheet 104 without additional structural support. For example, the first flat-stock sheet 102 may have a first forward edge 106 and first aft edge 108 and the second flat-stock sheet 104 may have a second forward edge 110 and second aft edge 112. The first flat-stock sheet 102 may have an aft slot 114 that extends along a first central axis 116 from the first aft edge 108. In some embodiments, the aft slot 114 may extend 50% of the length of the first flat-stock sheet 102. The second flat-stock sheet 104 may have a forward slot 118 that extends along a second central axis 120 from the second forward edge 110. In some embodiments, the forward slot 118 may extend 50% of the length of the second flat-stock sheet 104. In other embodiments, a length of the aft slot 114 and a length of the forward slot 118 may sum to 100% of the length of the first flat-stock sheet 102 and/or the second flat-stock sheet 104.

In some embodiments, the first flat-stock sheet 102 may include a first cutout area 122 and the second flat-stock sheet 104 may include a second cutout area 124. The first cutout area 122 and second cutout area 124 may complimentarily form a cutout volume in the assembled aerial vehicle, as will be described in relation to the FIG. 3. For example, guidance, navigation, control, batteries, receivers, and other associated electronics may be accommodated in the cutout volume. In some embodiments, the first flat-stock sheet 102 may include a pair of first propulsor cutouts 126 and the second flat-stock sheet 104 may include a pair of second propulsor cutouts 128. The pair of first propulsor cutouts 126 and pair of second propulsor cutouts 128 may each accommodate a pair of aerodynamic propulsors, as will be described in relation to the FIG. 3. For example, a propeller and associated motor may be accommodated in each cutout of the pair of first propulsor cutouts 126 and the pair of second propulsor cutouts 128. The pair of first propulsor cutouts 126 and pair of second propulsor cutouts 128 may take any geometric form, but are shown in a rectangular profile. In at least one embodiment, the propeller-motor pairs may be integrated principally such that the primary rotational axis lies within the plane of the first flat-stock sheet 102 and/or second flat-stock sheet 104, respectively. Tilt mechanisms may be included to allow for swivel actuation such that the primary axis can lie outside of the plane of the flat structural material. For applications which demand an even higher level of control authority in pitch, roll and yaw control, first turning vane flaps 130 and/or second turning vane flaps 132 may be included on the first flat-stock sheet 102 and/or the second flat-stock sheet 104, respectively.

Figure 2:
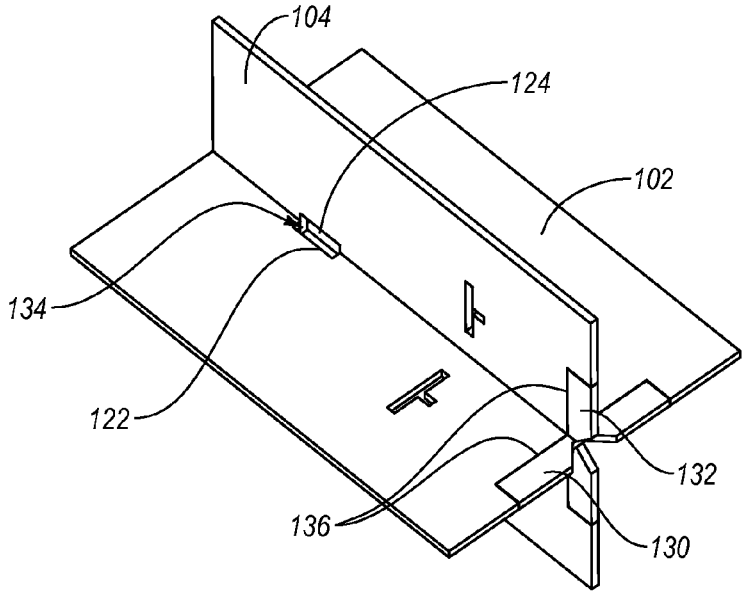
FIG. 2 is a perspective view of the embodiment of a pair of flat-stock sheets described in FIG. 1 assembled as an embodiment of a cruciform aerial vehicle, according to the present disclosure.

The two sheets shown in FIG. 1 are configured for orthogonal mating as shown in FIG. 2. Although the angle between the first flat-stock sheet 102 and the second flat-stock sheet 104 is shown as 90°, in some embodiments, the angles between the two (or more) sheets may be within a range having lower and upper values that include any of 5°, 10°, 15°, 25°, 35°, 45°, 55°, 65°, 70°, 75°, 80°, 85°, 90°, or any value therebetween. For example, the angle between the first flat-stock sheet 102 and the second flat-stock sheet 104 may be in a range of 5° to 90°. In another example, the angle between the first flat-stock sheet 102 and the second flat-stock sheet 104 may be in a range of 30° to 80°. In yet another example, the angle between the first flat-stock sheet 102 and the second flat-stock sheet 104 may be in a range of 40° to 60°.

The first flat-stock sheet 102 and the second flat-stock sheet 104 may be joined by engaging the aft slot 114 and the forward slot 118 such that the first flat-stock sheet 102 and the second flat-stock sheet 104 longitudinally overlap one another. In some embodiments, the first flat-stock sheet 102 and the second flat-stock sheet 104 may be fixed relative to one another after engaging the aft slot 114 and the forward slot 118 by the application of a bead or corner of adhesive or structural filleting material. In other embodiments, the first flat-stock sheet 102 and the second flat-stock sheet 104 may be fixed relative to one another by the application of a mechanical fastener such as a pin, bolt, screw, other connector, or combinations thereof to limit or substantially prevent the movement of the first flat-stock sheet 102 and the second flat-stock sheet 104 relative to one another. Fixation of the first flat-stock sheet 102 and the second flat-stock sheet 104 relative to one another may ensure the first cutout area 122 and second cutout area 124 may complimentarily form a cutout volume 134 in the assembled aerial vehicle.

Hinge lines 136 of the first turning vane flaps 130 and/or second turning vane flaps 132 may be constructed of any suitably flexible material or mechanical connection to allow the movement of the first turning vane flaps 130 and/or second turning vane flaps 132 relative to the first flat-stock sheet 102 and/or the second flat-stock sheet 104.

Figure 3:
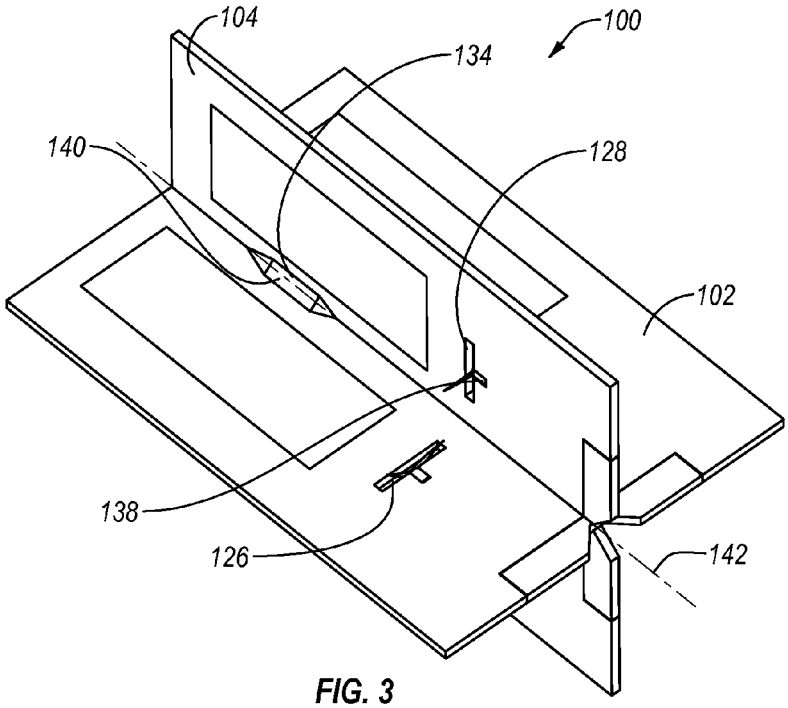
FIG. 3 is a perspective view of the cruciform aerial vehicle of FIG. 2 outfitted with flight components and sample artwork, according to the present disclosure.

FIG. 3 illustrates an assembled convertible aerial vehicle 100 including the first flat-stock sheet 102, the second flat-stock sheet 104, a plurality of aerodynamic propulsors 138, and an electronics package 140. In some embodiments, the plurality of aerodynamic propulsors 138 may be longitudinally aligned and distributed evenly about a central axis of the aerial vehicle 100. In some embodiments, the electronics package 140 may include a guidance system, navigation system, control system, energy storage device, communications module, other electronic systems, or combinations thereof. In some embodiments, the electronics package 140 may be positioned to provide proper mass balance to the aerial vehicle 100, thereby maintaining a positive static margin in all flight modes and enabling in-flight transitions. In other embodiments, the electronics package 140 may be positioned in the cutout volume 134. In yet other embodiments, the electronics package 140 or other component, once positioned in the cutout volume 134, may act as a key, which limits or substantially prevents the movement of the first flat-stock sheet 102 and the second flat-stock sheet 104 relative to one another.

Figure 4:
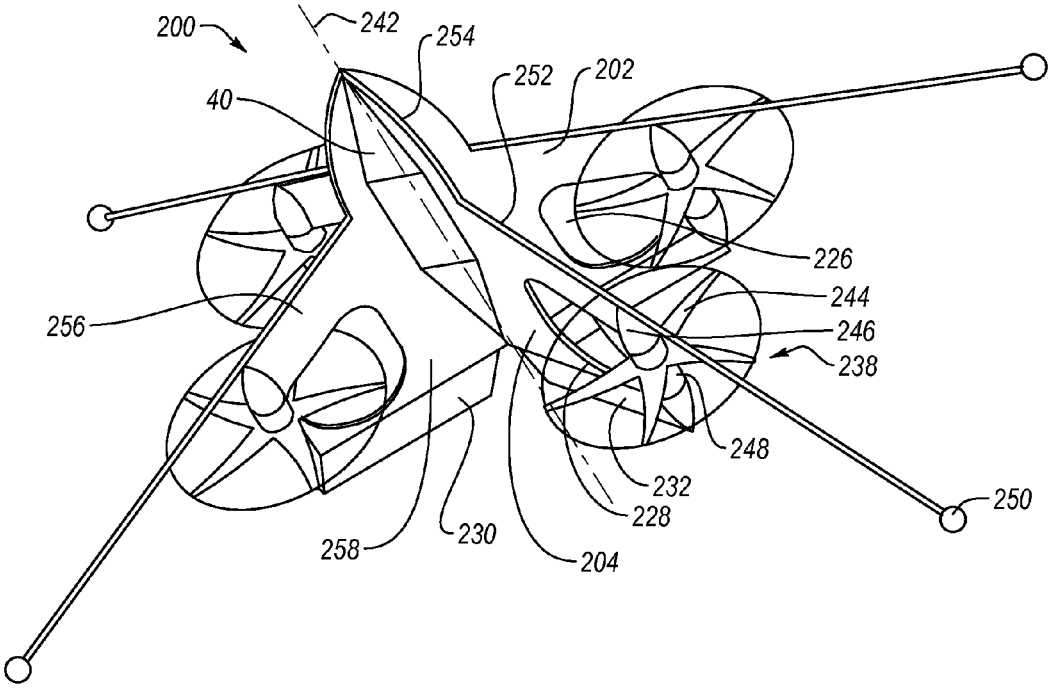
FIG. 4 illustrates an embodiment of a flat-stock convertible aerial vehicle outfitted with landing gear and four propellers in a non-perpendicular configuration, according to the present disclosure.

FIG. 4 illustrates another embodiment of an aerial vehicle 200. The embodiment of the aerial vehicle 200 shown in FIG. 4 reduces and/or minimizes wetted area, which may lend better high speed performance while enabling more efficient hover capabilities. The embodiment shown in FIG. 4 is shown with two flat-stock sheets of materials. A first flat-stock sheet 202 and a second flat-stock sheet 204 may be built to accommodate an aft slot and/or include cutouts for all of the same components as shown in FIG. 1 through FIG. 3, but in much more compact form factor.

Proportionately larger first propulsor cut-outs 226 and second propulsor cut-outs 228 for accommodating aerodynamic propulsors 238 may increase aerodynamic efficiency of the aerial vehicle 200. The first propulsor cutouts 226 and second propulsor cutouts 228, in the illustrated embodiment, may be proportionately larger than those of the aerial vehicle 100 described in relation to FIG. 1 through FIG. 3. The increased area may reduce wetted area and lower skin friction drag. The proportionately larger first propulsor cutouts 226 and second propulsor cutouts 228 may help reduce propeller wake pulse impingement on lower surfaces of the first flat-stock sheet 202 and/or second flat-stock sheet 204.

The first turning vane flaps 230 and/or second turning vane flaps 232 may be used for added pitch, roll and yawing moment control as well as aid in translation manipulation and control. The first turning vane flaps 230 and/or second turning vane flaps 232 are effective when exposed to the propwash developed by the aerodynamic propulsors 238. In some embodiments, the first turning vane flaps 230 and/or second turning vane flaps 232 may be sized to have a lateral length (measured radially from a longitudinal axis 242) that is similar to or the same as a diameter of the aerodynamic propulsors 238 and/or associated propwash. In other embodiments, the first turning vane flaps 230 and/or second turning vane flaps 232 may be sized to have a lateral length that is substantially the same as the lateral length of the first flat-stock sheet 202 and/or the second flat-stock sheet 204, respectively. In yet other embodiments, the first turning vane flaps 230 and/or second turning vane flaps 232 may be sized to have a lateral length that is less than the lateral length of the first flat-stock sheet 202 and/or the second flat-stock sheet 204, respectively. In some embodiments, at least a portion of each of the first turning vane flaps 230 and/or second turning vane flaps 232 may be positioned in the propwash (i.e., behind an aerodynamic propulsor 238). In other embodiments, substantially all of each of the first turning vane flaps 230 and/or second turning vane flaps 232 may be positioned in the propwash. The first turning vane flaps 230 and/or second turning vane flaps 232 may be deflected in unison or differentially when commanded by a flight controller and/or flight director incorporated in the electronics package 240.

In some embodiments, each of the aerodynamic propulsors 238 may include a rotor 244 driven by a powerpod 246. The powerpod 246 may include an electric motor 248 configured to rotate the rotor 244 at various rates depending on pilot commands and flight director commands to stabilize the aerial vehicle 200. In some embodiments, a thrust provided by the aerodynamic propulsor 238 may at least partially depend upon the rate at which the electric motor 248 rotates the rotor 244. In other embodiments, the powerpod 246 may include one or more motors to adjust the angle of the rotor 244 relative to the first flat-stock sheet 202 and/or second flat-stock sheet 204. For example, the powerpod 246 may tilt a plane defined by the rotating rotor 244 by various amounts to direct the thrust provided by the thrust from the aerodynamic propulsor 238. In some embodiments, the powerpod 246 may tilt the rotor 244 in a range having upper and lower values including any of up to 1°, 3°, 5°, 7°, 9°, 11°, 13°, 15°, or any value therebetween. For example, the powerpod 246 may tilt the rotor 244 in a range up to 15°degrees. In another example, the powerpod 246 may tilt the rotor 244 in a range of up to 10°degrees. In yet other embodiments, the powerpod 246 may include one or more motors that adjust the angle of the blades of the rotor 244. The powerpod 246 may increase or decrease the angle of the blades of the rotor 244 to increase or decrease the thrust of the aerodynamic propulsor 238 independently of the rate of rotation of the rotor 244.

The electric motor 248 may be integrated into powerpod 246 which may include aerodynamic fairings and may house, for example, electronics, fuel, batteries, other components, or combinations thereof. The powerpod 246 may additionally or alternatively house any combination of light emitting diodes for navigation or display and/or cameras for sensing to lend stereoscopic vision. Electronics for guidance, navigation, control, radio frequency signal reception and data or video transmission may be located in the electronics package 240 and may be in electrical and/or data communication with at least one of the powerpods 246. This electronics package 240 may form part of a counterbalance which shifts a center of mass of the aerial vehicle 200 forward, thereby establishing a positive static margin.

Equation 1 illustrates the relationship of the position of the aircraft center of mass to establishing a positive static margin. The center of mass position of the aircraft may be in front of the aerodynamic center in all flight modes. Because all of the turning vane flaps are aligned with high dynamic pressure slipstreams, the dynamic pressure ratios may be comparatively high in the empennage. This feature aids the establishment of high level static margins, which in turn help lend favorable flight qualities to the aircraft. At least one embodiment may be designed according to Equation 1.

$$SM = \frac{(\overline{X}_{acw} + \Delta\overline{X}_{acf})C_{Lawf} + \eta_h C_{Lah}(1 - d\varepsilon/d\alpha)\frac{S_h}{S}\overline{X}_{ach}}{C_{Lawf} + \eta_h C_{Lah}(1 - d\varepsilon/d\alpha)\frac{S_h}{S}} - \overline{X}_{cg} \quad \text{(eq. 1)}$$

where SM is the Static Margin of the aircraft $\overline{X}_{acw}$ is the nondimensional aerodynamic center location of the wing $\overline{X}_{ach}$ is the nondimensional aerodynamic center location of the empennage $\Delta\overline{X}_{acf}$ is the nondimensional shift in aerodynamic center of the aircraft due to the presence of the fuselage $\overline{X}_{cg}$ is the nondimensional center of gravity location of the aircraft center of gravity $C_{Lawf}$ is the lift curve slope of the wing-fuselage combination $C_{Lah}$ is the lift curve slope of the empennage $\eta_h$ is the dynamic pressure ratio over the empennage $d\epsilon/d\alpha$ is the downwash gradient with respect to change in angle of attack $S_h$ is the empennage area S is the wing area The embodiment of an aircraft shown in FIG. 4 may include a number of landing gear pads 250. In some embodiments, the landing gear pads 250 may form a platform from which takeoffs and landings of the aerial vehicle 200 may be executed. In other embodiments, the landing gear pad 250 may be supported by a support member 252 that may form a protective cage around the aerodynamic propulsor 238 (in particular, the rotors 244) to protect both the aerodynamic propulsor 238 from striking obstacles and protect obstacles from the aerodynamic propulsor 238. In yet other embodiments, the landing gear pads 250 and support member 252 may shift both the local aerodynamic center and center of gravity of the wing structure forward. For example, an aerodynamic propulsor 238 may be mounted in the first flat-stock sheet 202 in the first propulsor cutout 226, and the location of the aerodynamic propulsor 238 may define a forward wing portion 256 and an aft wing portion 258 of the first flat-stock sheet 202. In some embodiments, the support member 252 may be connected to the forward wing portion 256 and provide additional support to the forward wing portion 256.

The additional support from the support member 252 may facilitate overall aircraft stability, facilitate aeromechanical stability of the surface, and mitigate flutter tendencies of the forward wing portion 256 and, directly or indirectly, the aft wing portion 258. The support member 252 may form the forward attach point of the powerpods, and may stabilize the forward portions of the powerpods. The support member 252 may be directly bonded to the leading edge 254 of the first flat-stock sheet 202 and/or the second flat-stock sheet 204, integrated into the forward wing portion 256 and/or aft wing portion 258, or may be removable by any of a number of different mechanisms. The support member 252 may further reinforce the first flat-stock sheet 202 and/or the second flat-stock sheet 204 against impacts with stationary objects or with other aerial vehicles. For example, a plurality of aerial vehicles described herein may engage in aerial "combat" as toys wherein they are intentionally flown into one another. As combative toys, such hardened leading edges 254 may provide one combatant an advantage in competition and/or durability over another which only uses unprotected conventional wing materials. As described herein, the tips of each support member 252 may include a landing gear pad 250, which may, in addition to providing a stable base for takeoff and landing, may lend to the aircraft an improved level of safety should any person be hit by the tip of the landing gear.

In some embodiments, at least two of the plurality of aerodynamic propulsors 238 may be at different longitudinal positions relative to the longitudinal axis 242 of the aerial vehicle 200. In other embodiments, at least two of the plurality of aerodynamic propulsors 238 may be at different lateral distances relative to the longitudinal axis 242 of the aerial vehicle 200.

Figure 5:
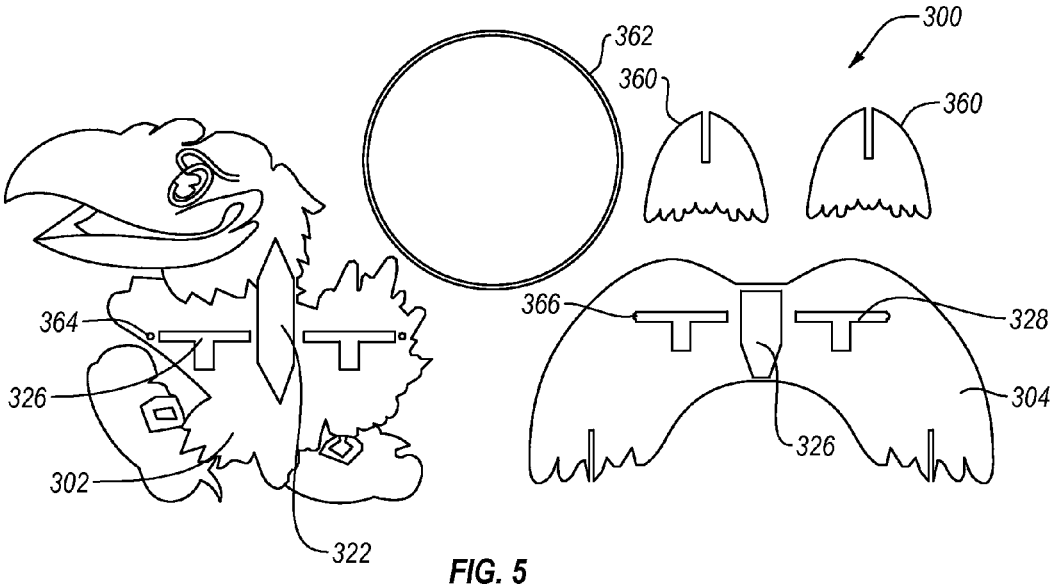
FIG. 5 illustrates an embodiment of flat-stock structural components and a structural ring propeller guard for an embodiment of a multi-propeller, convertible asymmetric aerial vehicle, according to the present disclosure.

In other embodiments, an aerial vehicle may comprise flat-stock sheets having irregular or asymmetric shapes, which may be configured to allow the aerial vehicle to resemble or evoke other objects for novelty, marketing, or other beneficial purposes. FIG. 5 illustrates an embodiment of an aerial vehicle 300 with flat-stock-sheets configured to resemble an animal. This flying animal pattern embodiment may include a first flat-stock sheet 302, second flat-stock sheet 304, one or more stabilizers 360, and a guard member 362, which form the primary structure of the aerial vehicle 300. The first flat-stock sheet 302 may have first propulsor cutouts 326 and the second flat-stock sheet 304 may have second propulsor cutouts 328, each of which may be configured to house and/or accommodate an aerodynamic propulsor.

The one or more stabilizers 360 may engage with the first flat-stock sheet 302 and/or second flat-stock sheet 304 to provide stabilization to the aerial vehicle 300. The one or more stabilizers 360 may provide additional aerodynamic stability to the aerial vehicle 300 in embodiments with irregular or asymmetric shapes that may be aerodynamically unstable independently. In some embodiments, the one or more stabilizers 360 may engage with the first flat-stock sheet 302 and/or second flat-stock sheet 304 through a slotted joint, similar to that described in relation to the first flat-stock sheet 102 and second flat-stock sheet 104 of FIG. 1. In other embodiments, the one or more stabilizers 360 may engage with the first flat-stock sheet 302 and/or second flat-stock sheet 304 by an adhesive, a bonding of the one or more stabilizers 360 with the first flat-stock sheet 302 and/or second flat-stock sheet 304, a mechanical fastener, or combinations thereof. In at least one embodiment, the one or more stabilizers 360 may function as empennage at or near the aft of the aerial vehicle 300.

The aerial vehicle 300 may include a guard member 362 that is configured to support the first flat-stock sheet 302 and second flat-stock sheet 304 relative to one another and/or protect the aerodynamic propulsors and/or other electronic components of the aerial vehicle 300. For example, the guard member 362 may be a hoop, ring, square, ellipse, or other shape of resilient material configured to withstand impacts during a crash or other flight of the aerial vehicle 300. The guard member 362 may be made of or include metal, plastics, wood, paper composites, or other resilient materials. The guard member 362 may engage with the first flat-stock sheet 302 and/or second flat-stock sheet 304 through one or more apertures 364 therethrough and/or through one or more recesses 366 in the first propulsor cutouts 326 and/or second propulsor cutouts 328.

The first flat-stock sheet 302 may include a first cutout area 322 and the second flat-stock sheet 304 may include a second cutout area 324. In some embodiments, the first cutout area 322 in the first flat-stock sheet 302 may be sized to allow some or all of the second flat-stock sheet 304 to be inserted through the first cutout area 322. For example, the first cutout area 322 may be configured to allow the second flat-stock sheet 304 to be inserted through the first flat-stock sheet 302 until the second cutout area 324 (of the second flat-stock sheet 304) is substantially aligned with the first cutout area 322. Similar as described in relation to the aerial vehicle 100 described in relation to FIG. 1 through FIG. 3, the alignment of the first cutout area 322 and second cutout area 324 of the aerial vehicle may allow an electronics package or other component to be retained in a cutout volume and the electronics package or other component may limit the relative movement of the first flat-stock sheet 302 and the second flat-stock sheet 304.

Figure 6:
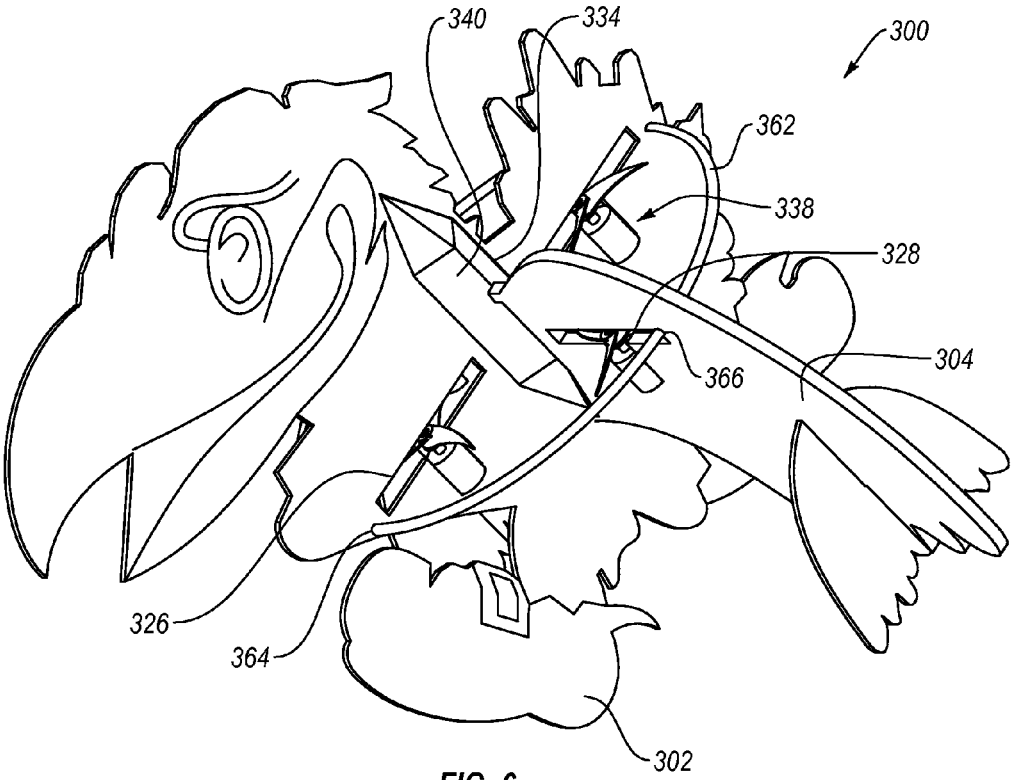
FIG. 6 illustrates the embodiment of flat-stock structural components and a structural ring propeller guard of FIG. 5 as an embodiment of an assembled flying mascot, according to the present disclosure.

FIG. 6 illustrates the embodiment of the aerial vehicle 300 in an assembled configuration. The aerial vehicle 300 in an assembled configuration may include electronic and/or motive components such as an electronics package 340. The electronics package 340 may be configured to fit in a cutout volume 334 defined by the alignment of the first cutout area 322 and the second cutout area 324. A component located in the cutout volume 334 may function as a key, limiting or substantially preventing the movement of the first flat-stock sheet 302 and the second flat-stock sheet 304 relative to one another. For example, the placement of the electronics package 340 or another component in the cutout volume 334 may limit or substantially prevent the movement of the first flat-stock sheet 302 and the second flat-stock sheet 304 relative to one another. The key, such as the electronics package 340, may be retained in the cutout volume 334 by adhesives, a mechanical fastener, an interference fit, a snap fit, other connection mechanisms, or combinations thereof. In some embodiments, the electronics package 340 may include aerodynamic fairings.

The guard member 362 may engage with the first flat-stock sheet 302 and/or second flat-stock sheet 304 through one or more apertures 364 therethrough and/or through one or more recesses 366 in the first propulsor cutouts 326 and/or second propulsor cutouts 328. The guard member 362 may be configured to provide support to the first flat-stock sheet 302 and/or second flat-stock sheet 304 by mounting substantially perpendicularly to both the first flat-stock sheet 302 and the second flat-stock sheet 304. In other embodiments, the guard member 362 may be connected to the first flat-stock sheet 302 and/or second flat-stock sheet 304 at other relative angles, including any of 30°, 40°, 50°, 60°, 70°, 80°, or any value therebetween. The aerodynamic propulsors 338 and/or powerpods may be positioned within the first propulsor cutouts 326 and the second propulsor cutouts 328, as described herein.

Figure 7:
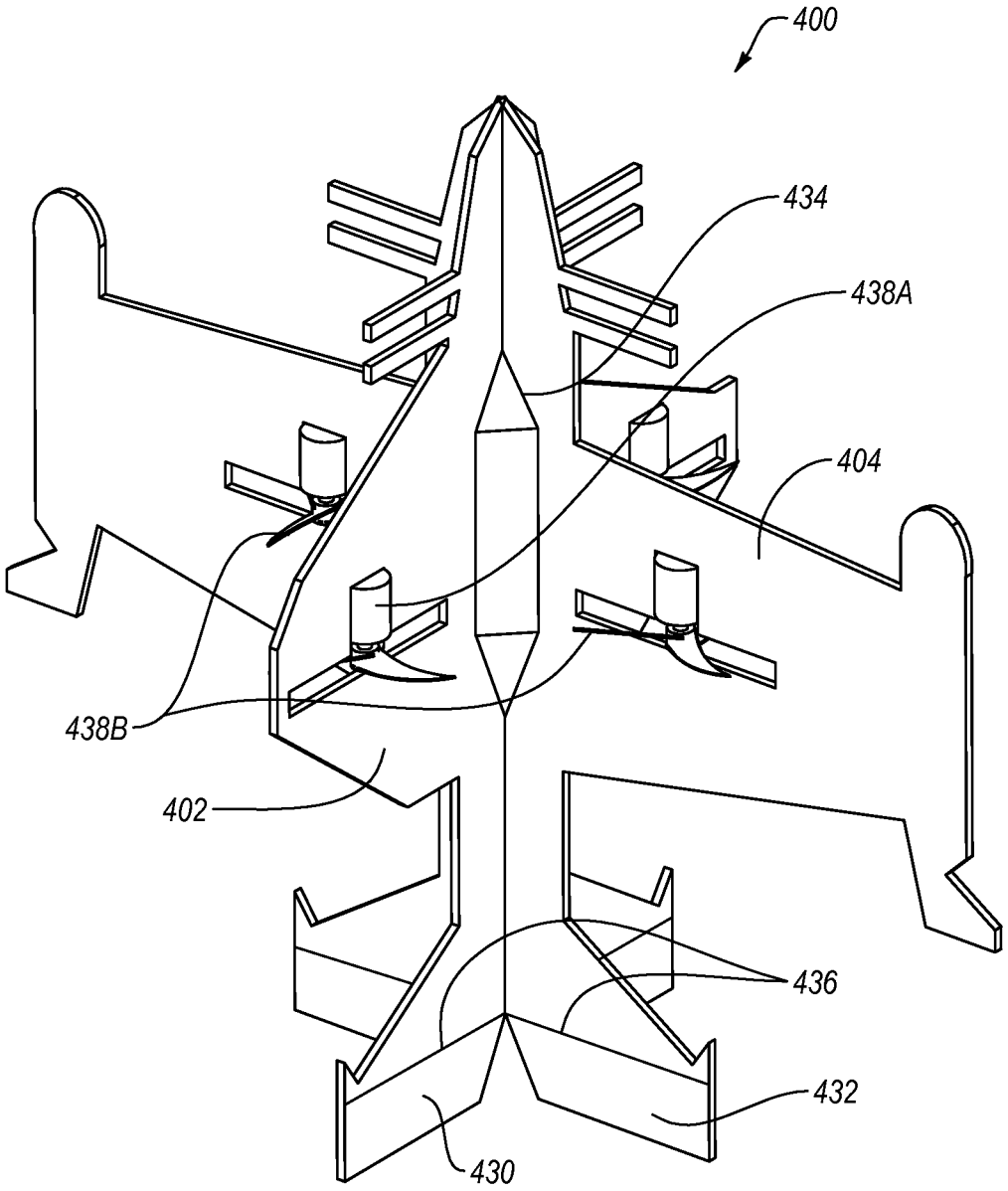
FIG. 7 illustrates an embodiment of a flat-stock vintage aircraft including a plurality of propellers that is capable of in-flight conversions and acrobatics, according to the present disclosure.

The asymmetrical and/or irregular patterns may allow shapes replicating vintage aircraft to be flown by using this fundamental layout. FIG. 7 illustrates embodiment of an aerial vehicle 400 replicating a vintage aircraft design. The aerial vehicle 400 may include a plurality of flat-stock sheets including a laterally asymmetrical first flat-stock sheet 402 and a laterally symmetrical second flat-stock sheet 404. The first flat-stock sheet 402 may replicate a fuselage of an aircraft, and the second flat-stock sheet 404 may replicate the wing set of the aircraft. The first flat-stock sheet 402 and/or second flat-stock sheet 404 may include first and second cutout areas that may define a cutout volume 434, as described herein.

The aerial vehicle 400 may have constrained dimensions of the first flat-stock sheet 402 and/or second flat-stock sheet 404 relative to the size of the electronic package 440, aerodynamic propulsors, other electronics, or other components supported by the body of the aerial vehicle 400. In some embodiments, the aerial vehicle 400 may include two pairs of aerodynamic propulsors that may or may not be longitudinally aligned or radially equidistance. For example, the aerial vehicle 400 may include a first pair of aerodynamic propulsors 438A and a second pair of aerodynamic propulsors 438B. In some embodiments, the first pair of aerodynamic propulsors 438A may be located forward or aft of the second pair of aerodynamic propulsors 438B. In other embodiments, the first pair of aerodynamic propulsors 438A may be located further from or closer to the longitudinal axis of the aerial vehicle 400 than the second pair of aerodynamic propulsors 438B.

The empennage of the aerial vehicle may include first turning vane flaps 430 and second turning vane flaps 432, which, in the depicted embodiment, may replicate rudder elements and elevators. The turning vane flaps may be moved about hinges 436 which may be built from any structural material and/or mechanical arrangement of components to allow rotation about denoted hinge lines. In some embodiments, adhesives and/or mechanical fasteners may join the first flat-stock sheet 402 and second flat-stock sheet 404. In other embodiments, the electronics package 440 may be integrated to provide proper balance and level of static margin and/or limit movement of the first flat-stock sheet 402 and second flat-stock sheet 404 relative to one another.

Figure 8:
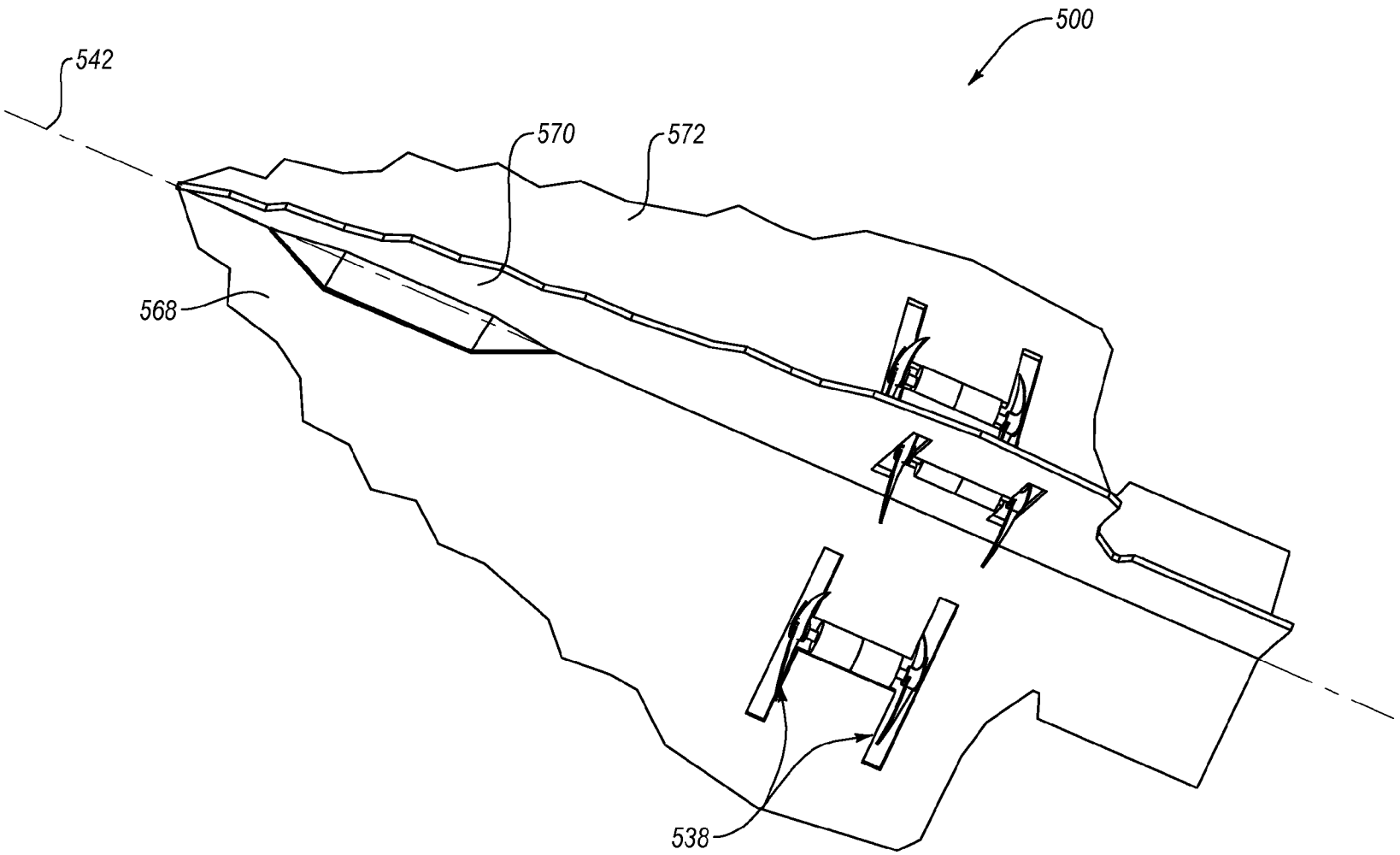
FIG. 8 illustrates an embodiment of an arrowhead-shaped convertible aircraft including a plurality of propellers and including mostly planar structural materials, according to the present disclosure.

FIG. 8 illustrates an embodiment of a three-sheet panel embodiment of aerial vehicle 500 that includes a plurality of aerodynamic propulsors. The aerial vehicle 500 may include a plurality of flat-stock sheets 568, 570, 572 joined at a longitudinal axis 542 of the aerial vehicle 500. In some embodiments, the plurality of flat-stock sheets may be arranged about the longitudinal axis at equal angular intervals, at least partially based upon the quantity of flat-stock sheets. For example, the depicted embodiment has three flat-stock sheets 568, 570, 572 joined at the longitudinal axis 542 at 120° intervals from one another. In other embodiments, an aerial vehicle having six flat-stock sheets may have the six flat-stock sheets joined about the longitudinal axis at 600 intervals.

Embodiments of aerial vehicles having an odd number of flat-stock sheets, such as the aerial vehicle 500 in FIG. 8, may be less stable than embodiments of aerial vehicles with symmetrically opposed (i.e., mirrored about the longitudinal axis 542) aerodynamic propulsors. In some embodiments, each flat-stock sheet 568, 570, 572 of the aerial vehicle 500 may include at least two aerodynamic propulsors 538 to maintain balance and control in pitch, roll and yaw. The at least two aerodynamic propulsors 538 in each flat-stock sheet 568, 570, 572 may be displaced longitudinally and/or radially relative to one another to enable moment control about the longitudinal axis 542. The multiple pairs of aerodynamic propulsors 538 may be driven differentially so as to allow for combinations of rotor speeds and direction to control both forces and moments generated by the combined motor-propeller assemblies.

Figure 9:
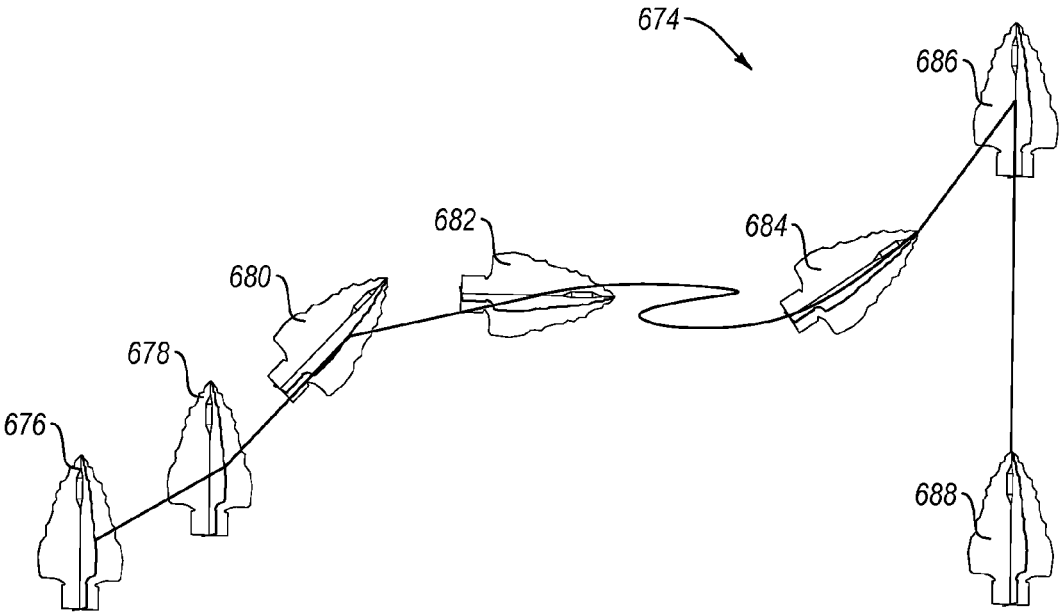
FIG. 9 illustrates an embodiment of a flight of a convertible aerial vehicle including both hover flight and translational flight, according to the present disclosure.
Figure 10:
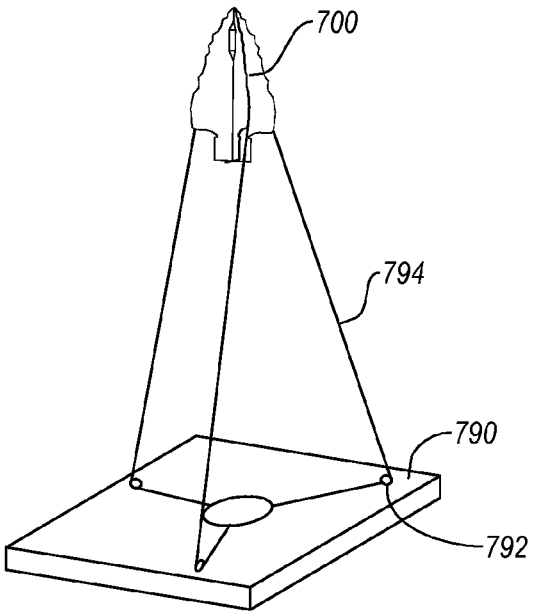
FIG. 10 illustrates an embodiment of a multi-propeller aircraft made from flat-stock including a tether in a tethered recovery mode and a tethered flight mode, according to the present disclosure.

At least one embodiment of an aircraft described herein is capable of stable hover flight, mid-flight conversion, and translational flight like an airplane. FIG. 9 illustrates an example dual conversion flight 674. The aerial vehicle 600 may takeoff 676 vertically and hover 678. The aerial vehicle 600 may move laterally and vertically in a hover 678. More power may be applied and the aerial vehicle 600 may pitch over, converting 680 the flight to a translational flight 682, similar to an airplane flight. During translational flight 682, the aerial vehicle 600 may fly in any number of maneuvers like any typical airplane plus some special maneuvers which are may be enabled only by at least one embodiment of an aerial vehicle described herein such as, for example, reverse hammer-heads, ascending Cobras, backwards flight and reverse nose dives. To reduce forward airspeed and convert again from translational flight 682 to hover flight, the aerial vehicle 600 may execute a zoom climb 684. At the stage when the kinetic energy of the aerial vehicle 600 is exhausted, the aerial vehicle 600 may be fully converted 686. Then the aircraft may back down and land 688 in hover flight.

An embodiment of an aerial vehicle described herein may include a tethered variant of the aerial vehicle 700 which may be launched from an earth-, building- or vehicle-fixed launch pad 790. The aerial vehicle 700 may be launched from a stowed position to an elevated position by, for example, paying out lines through feed mechanisms 792 and/or elongating the supporting lines 794. The supporting lines 794 can carry not only structural loads in the form of tension, but may also provide a degree of stabilization and may transfer electrical power vertically from the base to the aircraft and any command signals to motor, pan, tilt, zoom mechanisms, then convey downwards the corresponding video and sensory signals. In some embodiments, the tethered aerial vehicle 700 may be tethered by at least one supporting line 794. In other embodiments, the tethered aerial vehicle 700 may be tethered by a number of supporting lines 794 equal to the number of flat-stock sheets in the tethered aerial vehicle 700. In yet other embodiments, the tethered aerial vehicle 700 may be tethered by more supporting lines 794 than the number of flat-stock sheets in the tethered aerial vehicle 700.

Various embodiments have been described herein including various components. Components from one embodiment may be combined with components from another embodiment. For example, the landing gear of the embodiment described in relation to FIG. 4 may be combined with the flat-stock sheet angular arrangement of the embodiment described in relation to FIG. 8. In another example, the guard member of the embodiment described in relation to FIG. 6 may be combined with the landing gear of the embodiment described in relation to FIG. 4.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A flat-stock aerial vehicle comprising:

a body having a forward body edge, an aft body edge, and a longitudinal axis, the body including:

a first flat-stock sheet having a first forward edge and a first aft edge and having an aft slot therein extending forward from the first aft edge, and a second flat-stock sheet having a second forward edge and a second aft edge and having a forward slot therein extending aft from the second forward edge, wherein the aft slot is configured to engage with the forward slot;

at least one motor; and at least three aerodynamic propulsors positioned between the forward body edge and aft body edge, the at least three aerodynamic propulsors defining a forward wing portion and an aft wing portion, the at least three aerodynamic propulsors driven by the at least one motor, the at least three aerodynamic propulsors being configured to provide lifting thrust, pitch, yaw, and roll control to the vehicle.

2. The flat-stock aerial vehicle of claim 1, wherein at least a portion of the body is made from flat-stock which is planar or possesses simple curves.

3. The flat-stock aerial vehicle of claim 1, wherein at least a portion of the body is made from laminated flat-stock which is planar or possesses simple curves.

4. The flat-stock aerial vehicle of claim 1, wherein the body has at least one cutout to accommodate electronics, motors, propellers, landing gear, or lights.

5. The flat-stock aerial vehicle of claim 1, further comprising removable landing gear which extend laterally beyond the radial outermost position of the at least three aerodynamic propulsors.

6. The flat-stock aerial vehicle of claim 1, further comprising light emitting devices to be used to enhance visibility and situational awareness or advertising.

7. The flat-stock aerial vehicle of claim 1, wherein the first flat-stock sheet or second flat-stock sheet is strengthened by a support member along a leading edge.

8. The flat-stock aerial vehicle of claim 1, wherein the first flat-stock sheet and second flat-stock sheet are connected by an adhesive.

9. The flat-stock aerial vehicle of claim 1, further comprising a plurality of turning vanes located at the aft edge of the body.

10. A flat-stock aerial vehicle comprising:

a body having a forward body edge, an aft body edge, and a longitudinal axis, the body including a plurality of flat-stock sheets, the plurality of flat-stock sheets being joined together along the longitudinal axis and the plurality of flat-stock sheets being arranged around the longitudinal axis at equal angular intervals;

at least one motor; and at least three aerodynamic propulsors positioned between the forward body edge and aft body edge, the at least three aerodynamic propulsors defining a forward wing portion and an aft wing portion, the at least three aerodynamic propulsors driven by the at least one motor, the at least three aerodynamic propulsors being configured to provide lifting thrust, pitch, yaw, and roll control to the vehicle.

11. The flat-stock aerial vehicle of claim 10, further comprising an electronics package located in the longitudinal axis of the body and supported by the plurality of flat-stock sheets.

12. The flat-stock aerial vehicle of claim 10, wherein each of the at least three aerodynamic propulsors is operably connected to a powerpod configured to move the aerodynamic propulsors.

13. The flat-stock aerial vehicle of claim 10, wherein each of the plurality of flat-stock sheets are connected to one another by a mechanical fastener.

14. The flat-stock aerial vehicle of claim 10, further comprising at least one communications module to allow remote communication therewith.

15. The flat-stock aerial vehicle of claim 10, further comprising a tether and a base such that the aerial vehicle is tethered to the base so as to be raised or lowered by paying out more or less cable.

16. A flat-stock aerial vehicle comprising:

a body having a forward body edge, an aft body edge, and a longitudinal axis, the body including:

a first flat-stock sheet having a first forward edge and a first aft edge and having a first cutout area located therein between the first forward edge and the first aft edge, and a second flat-stock sheet having a second forward edge and a second aft edge and a second cutout area, wherein the second flat-stock wing is configured to be inserted through the first cutout area such that the second cutout area aligns with the first cutout area to define a cutout volume;

a key positioned in the cutout volume, the key limiting movement of the first flat-stock sheet relative to the second flat-stock sheet;

at least one motor; and at least four aerodynamic propulsors positioned between the forward body edge and aft body edge, the at least three aerodynamic propulsors defining a forward wing portion and an aft wing portion, the at least three aerodynamic propulsors driven by the at least one motor, the at least three aerodynamic propulsors being configured to provide lifting thrust, pitch, yaw, and roll control to the vehicle.

17. The flat-stock aerial vehicle of claim 16, wherein the first flat-stock sheet is asymmetrical.

18. The flat-stock aerial vehicle of claim 16, further comprising one or more stabilizers.

19. The flat-stock aerial vehicle of claim 16, wherein the key is an electronics package including an energy storage device.

20. The flat-stock aerial vehicle of claim 16, further comprising a guard member that provides support between the first flat-stock sheet and second flat-stock sheet.

* * * * *